US007525496B2

(12) United States Patent
Francque et al.

(10) Patent No.: US 7,525,496 B2
(45) **Date of Patent: *Apr. 28, 2009**

(54) MOBILE PLATFORM WINDOW CHOKE RINGS FOR CONTROLLING ELECTROMAGNETIC INTERFERENCE WITH ELECTRONICS SYSTEMS

(75) Inventors: Craig Francque, Derby, KS (US); Phillip A. Lindsey, Atlanta, KS (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/122,042

(22) Filed: May 16, 2008

(65) Prior Publication Data

US 2008/0218421 A1 Sep. 11, 2008

Related U.S. Application Data

(63) Continuation of application No. 11/608,265, filed on Dec. 8, 2006, now Pat. No. 7,375,688.

(51) Int. Cl.
*H01Q 1/28* (2006.01)

(52) U.S. Cl. ..... 343/705; 343/708

(58) Field of Classification Search ..... 343/700 MS, 343/705, 708, 846, 909
See application file for complete search history.

(56) References Cited

U.S. PATENT DOCUMENTS 6,040,805 A * 3/2000 Huynh et al. ..... 343/785

* cited by examiner

*Primary Examiner*—Hoang V Nguyen
(74) *Attorney, Agent, or Firm*—McNees Wallace & Nurick, LLC

(57) ABSTRACT

A choke ring apparatus for attenuation of electromagnetic waves in a mobile platform fuselage includes a ground plane mounted on a surface of the fuselage. The choke ring has an axial circular window and a series of concentric circular ring segments on the ground plane arranged coaxially about the axis of the window. The circular ring segments extend from the ground plane. The ring segments defining at least one groove therebetween. The ring segments have a flat ridge at the edge, and each groove has a depth defined by a pair of adjacent ring segments. The width of the flat ridge surfaces and a width of the groove between adjacent ring segments are approximately equal. The depth of the groove is determined based on a predetermined resonant frequency, such that the choke ring apparatus selectively attenuates electromagnetic waves in a region of the resonant frequency when propagating through the window.

20 Claims, 5 Drawing Sheets

MOBILE PLATFORM WINDOW CHOKE RINGS FOR CONTROLLING ELECTROMAGNETIC INTERFERENCE WITH ELECTRONICS SYSTEMS

CROSS-REFERENCE TO RELATED APPLICATIONS

This application is a continuation of U.S. application Ser. No. 11/608,265 filed Dec. 8, 2006, now U.S. Pat. No. 7,375,688, which is hereby incorporated by reference in its entirety.

FIELD OF THE INVENTION

The present invention is directed to a method and apparatus for controlling electromagnetic interference in mobile platforms, and more particularly to choke ring structures mounted in a mobile platform fuselage to attenuate or eliminate interference caused by portable electronic devices carried onboard by passengers.

BACKGROUND OF THE INVENTION

There is concern in the aviation industry that portable electronic devices (PEDs) can interfere with mobile platform electronics systems (also referred to as avionics in mobile platform and space vehicle electronic applications). Mobile platforms as used herein include aircraft and space vehicles, as well as land-based and nautical transportation vehicles. Measurements of radiated energy levels in PEDs have been known to exceed earlier mobile platform equipment qualification standards, which afford less protection than current equipment standards and mobile platform certification requirements. This, combined with the increasingly widespread use of cell phones, could pose a threat to air safety.

There are two types of PEDs. First, there are those PEDs that intentionally transmit a signal, known as intentional transmitters. Intentional transmitters transmit a signal in order to accomplish their function. Intentional transmitters include cell phones; pagers; two-way radios; and remote-control toys. The second type of PED is the non-intentional transmitter. Non-intentional transmitters do not have to transmit a signal in order to accomplish their function. However, like most electrical devices, they emit some level of radiation. Examples of non-intentional transmitters include compact-disc players; tape recorders; hand-held games; laptop computers and personal digital assistants (PDAs); and laser pointers.

The Federal Aviation Administration (FAA) and other international aviation regulatory agencies have expressed concern that PEDs may interfere with navigational instruments aboard the mobile platform. There have been numerous anecdotal reports of incidents in which the use of PEDs apparently created anomalous or erroneous instrumentation signals in passenger mobile platform. The PEDs most frequently reported as being a source of interference are laptop computers. The most frequent mobile platform systems reportedly affected by a suspected PED interference source are the navigation systems. The FAA has implemented rules restricting the use of PEDs on commercial airlines. Such rules prohibit operation of a PED on an airplane unless the airline has determined that the device will not cause interference with the navigation or communication systems of the mobile platform. There are some exceptions, for example, portable voice recorders, hearing aids, heart pacemakers, and electric shavers, which may be used, and the rules do not apply at all in some cases, e.g., private planes flying under visual flight rules.

The FAA also recommends that the use of PEDs be prohibited during the takeoff and landing phases of flight below 10,000 feet, in order to avoid potential electronic interference with aircraft systems, and to avoid the potential for passengers to miss safety announcements. In response to the incidents and government regulations, airlines have attempted to restrict the use of portable electronic devices. Airline policies generally divide PEDs into three categories: those that may never be used, those that may always be used, and those that may be used only at certain times. PEDs such as hearing aids, pacemakers, electronic watches, and one-way pagers may generally be used at any time during flight. Conversely, most airlines prohibit certain PEDs at any time, e.g., AM/FM radios, television sets, two-way pagers, and CB radios. A third category of PEDs may be operated at specified times, i.e., prior to departure and after the mobile platform has reached an altitude of 10,000 feet. In particular, when the mobile platform is descending all PEDs in this category must be turned off. The PEDs subject to these restrictions include CD players, laptop computers, electronic video games, and GPS navigation sets. The pilot must be notified that all PEDs have been turned off before departure and/or descent. As for the use of cellular phones, many airlines permit passengers to place and receive calls onboard while the mobile platform is still at the gate. Otherwise, cell phones may not be used during airline takeoff and landings, or during flight.

As the use of passenger carry-on portable electronic devices (PEDs) becomes more prevalent, it may become considerably more difficult to maintain Electromagnetic Compatibility (EMC) between these devices and the mobile platform communications and navigation systems. The portability of these devices further makes it increasingly difficult to successfully implement traditional Electromagnetic Interference (EMI) solutions. The present invention provides a novel method and device with which to reduce or eliminate the potential for PED-to-mobile platform antenna coupled EMI that may occur through the coupling paths of the mobile platform fuselage window. The present invention may be implemented in new aircraft production as well as a retrofit application for aircraft in the field.

With the beginning of a multitude of inexpensive PEDs—i.e., electronic communications and data devices, it is likely that PEDs will consume more and more of the electromagnetic spectrum, whether by design, or unintentionally, e.g., in the form of harmonic or spurious signal emissions. In concert with an increase in the number of users and total emitter power, some of which utilize spread spectrum technology and increased power spectral content, mobile platform systems may be even more susceptible to EMI. Traditional mobile platform design does not incorporate EMI shielding in the mobile platform windows, thus allowing the possibility that electromagnetic energy can be coupled through the windows and into the externally-mounted mobile platform antennas. For example, the new Boeing 787 mobile platform design includes enlarged windows in the fuselage that may cause higher levels of PED-to-antenna coupled EMI through the windows.

As the quantity of PEDs in use during a flight increases, and in order to increase window size for passenger enjoyment, adequate space loss (attenuation) to mobile platform antennas may become nearly impossible. While traditional solutions, such as powering off of PEDs, may address interference at critical flight times, they do not address the potential for EMI during normal inflight conditions.

Choke ring ground planes have been employed in applications such as global positioning system (GPS) or various directional antennas, to reject multi-path signals from interfering with the primary signal being received by the antennas. As examples, U.S. Pat. No. 6,278,407 discloses dual-frequency choke-ring ground planes having an antenna mounted in the center of multiple grooved surfaces, and an electromagnetic filter structure which makes the depth of each groove appear to be different for each of two frequency bands, and also discloses using a groove depth which is either slightly less than a quarter-wavelength or greater than a quarter-wavelength of the second bandwidth L2. Also, U.S. Pat. No. 6,040,805 discloses a low profile ceramic choke for GPS antenna systems having concentric ring segments arranged coaxially about a circular antenna.

While the metallic structure of the fuselage provides shielding between internal EMI and externally mounted antennas, the windows that are positioned along the walls of the fuselage for passenger enjoyment do not adequately shield EMI from interfering with external antennas. Moreover, as mobile platform are designed to be more aesthetically pleasing to passengers, many mobile platform are designed with even larger windows. Therefore, there is a need for a means of attenuating signals that are generated within an enclosed structure such as a mobile platform, from interfering with the operation of external antenna from receiving direct signals, for example, navigation or communications signals from ground-based or satellite-based sources.

SUMMARY OF THE INVENTION

The present invention is directed to a choke ring apparatus for attenuation of electromagnetic waves in a mobile platform fuselage. The choke ring apparatus includes a ground plane mounted on a surface of the fuselage and having an axial aperture and at least one ring element attached to the ground plane arranged coaxially about a periphery of the axial aperture and extending from the ground plane. The choke ring apparatus selectively attenuates electromagnetic waves in a region of the resonant frequency when propagating through the aperture.

In another aspect the present invention is directed to an electromagnetic interference attenuation system for a mobile platform. The attenuation system includes a hollow fuselage having an interior surface portion and an exterior surface portion. Window portions are spaced at intervals along the fuselage. Each window portion is disposed between the interior and exterior surface portions and has a choke ring surrounding an aperture supporting the window portion; and communications antennas mounted on the fuselage exterior surface for receiving electromagnetic signals for onboard mobile platform electronic systems. Each choke ring portion has a ground plane mounted on a surface of the fuselage and has an axial aperture and at least one ring element attached to the ground plane arranged coaxially about a periphery of the axial aperture and extending from the ground plane. The choke ring apparatus selectively attenuates electromagnetic waves in a region of the resonant frequency when propagating through the aperture.

In yet another aspect the present invention is directed to an improved mobile platform window assembly. The improvement consists of a choke ring structure surrounding a periphery of the window assembly wherein RF energy generated internally in a mobile platform fuselage is inhibited from interfering with mobile platform antennas disposed externally on the mobile platform.

An advantage of the present invention is significant reduction of in-band and out-of-band coupled EMI between avionics/electronics systems and PEDs.

Another advantage is that the implementation of the choke ring requires only minor structural modifications to a mobile platform.

A further advantage is that the implementation and installation of the choke rings does not affect existing radio frequency (RF) coaxial interconnection between the externally mounted system antenna and the onboard mobile platform electronics.

Yet another advantage is greater flexibility for passengers using PEDs.

Still another advantage of the present invention is the reduced risk of interference with onboard electronics systems due to PEDs.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 2:
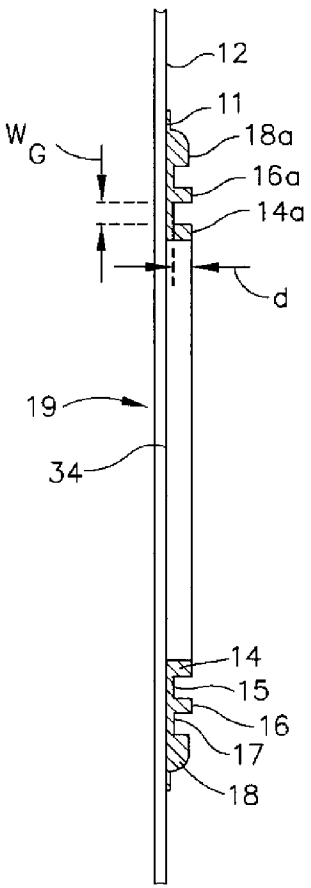
FIG. 2 is a cross-sectional view of the choke-ring structure taken along the lines 2-2 in FIG. 1.
Figure 1:
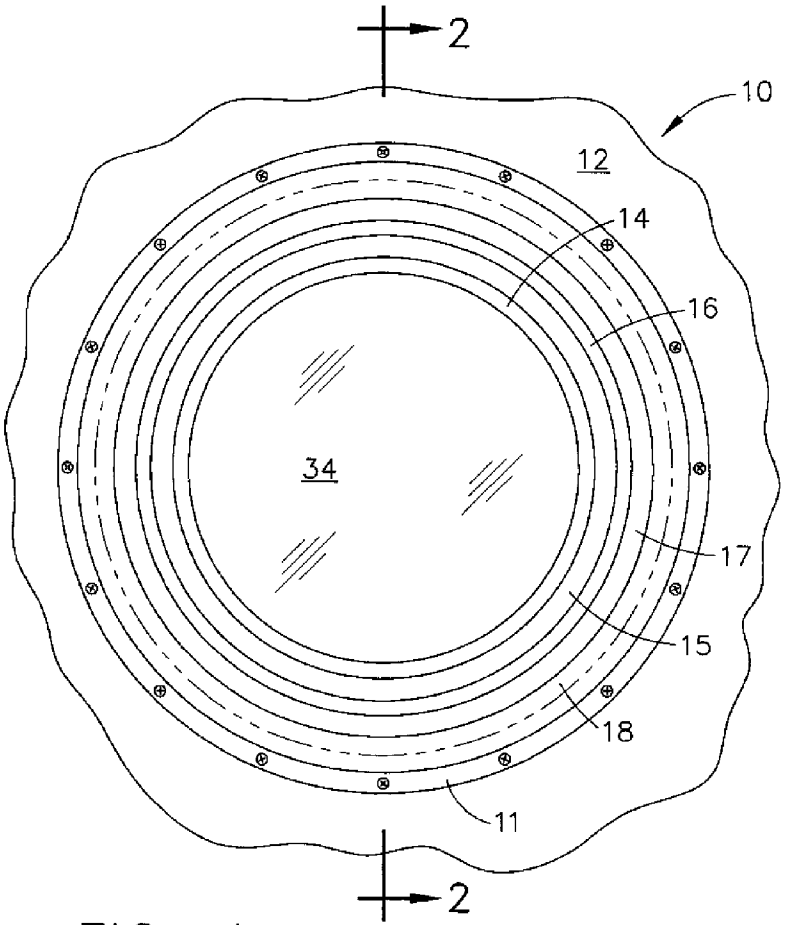
FIG. 1 is a partial view of a window from inside a mobile platform, with a choke-ring structure of the present invention.

Referring first to FIGS. 1 and 2, a choke ring structure 10 is integrated in the interior skin 12 of a fuselage of a mobile platform. Multiple concentric circular ring segments 14, 16 and 18 are coaxially disposed and project outwardly from a disk-shaped ground plane 11 having a center aperture 19 for placement of a mobile platform window 34. Note that the circular window 34 is exemplary, and the invention includes non-circular window configurations, e.g., elliptical or rectangular. If the window 34 is non-circular, the ring structure 10 conforms substantially with the geometry of the window aperture, such that the window is encircled by or contained within the choke ring structure 10. The ground plane 11 connects the ring segments 14, 16 and 18 to a common surface, e.g. the interior skin 12, although in alternate embodiments, an exterior skin or an intermediate surface (not shown) may be the common surface. The ground plane 11 is mounted on the interior skin 12, with the ring segments 14, 16 and 18 projecting generally perpendicularly to the ground plane 11, inwards to the interior of the fuselage. Adjacent ring segments 14 and 16 are separated by a groove 15; similarly, ring segments 16 and 18 are separated by a groove 17. Ring segments 14, 16 and 18 have flat ridge surfaces 14*a*, 16*a* and 18*a*. The grooves 15, 17 provide dielectric gaps between ring segments 14, 16 and 18. The grooves are preferably air gaps, or alternately, may include a dielectric material, e.g., ceramic, mica, glass, plastics, and oxides of various metals such as aluminum. The present invention includes almost limitless possibilities of cross sectional profiles—i.e., surface contours 14*a*, 16*a* and 18*a* are shown as flat ridges, however concave, convex, waveform, pointed, and other surface contours may be employed—and dielectric combinations for the choke ring structure 10. The dimensions of the ridge surfaces 14*a*, 16*a* and 18*a* in relation to the depth d of the adjacent grooves 15, 17 is predetermined by the selected resonant frequency ω for the choke ring. The resonant frequency ω has a wavelength $\lambda_r$. The depth d of the choke ring is approximately determined by the following equation:

$$d=\lambda_r/3.5 \qquad \text{Equation 1}$$

The width of the ridge surfaces 14*a*, 16*a* and 18*a* and the grooves 15 and 17 are about one quarter of the depth (d/4) of the ring segments 14, 16 and 18. The quarter wavelength relationship may be more precisely optimized by iteratively adjusting the choke geometric parameters to achieve maximum coupling reduction, but the general relationship of one quarter of the wavelength is generally effective. Further, the number of rings 14, 16 and 18 affects the attenuation of coupled directional power. More or less ring segments may be used, however, in the example of FIG. 1, through the iterative adjustment process described above the inventors have determined that three ring segments are generally more effective than a single choke ring configuration (not shown). An even numbers of rings may be used as well. Further, by varying the depth of the ring segments 14, 16 and 18, and the width of the grooves 15, 17 and ridge surfaces 14*a*, 16*a* and 18*a*, the choke ring structure 10 may achieve an increased bandwidth of signal attenuation. Thus, the geometry of the choke ring structure 10 may be designed for greater bandwidth.

Figure 3:
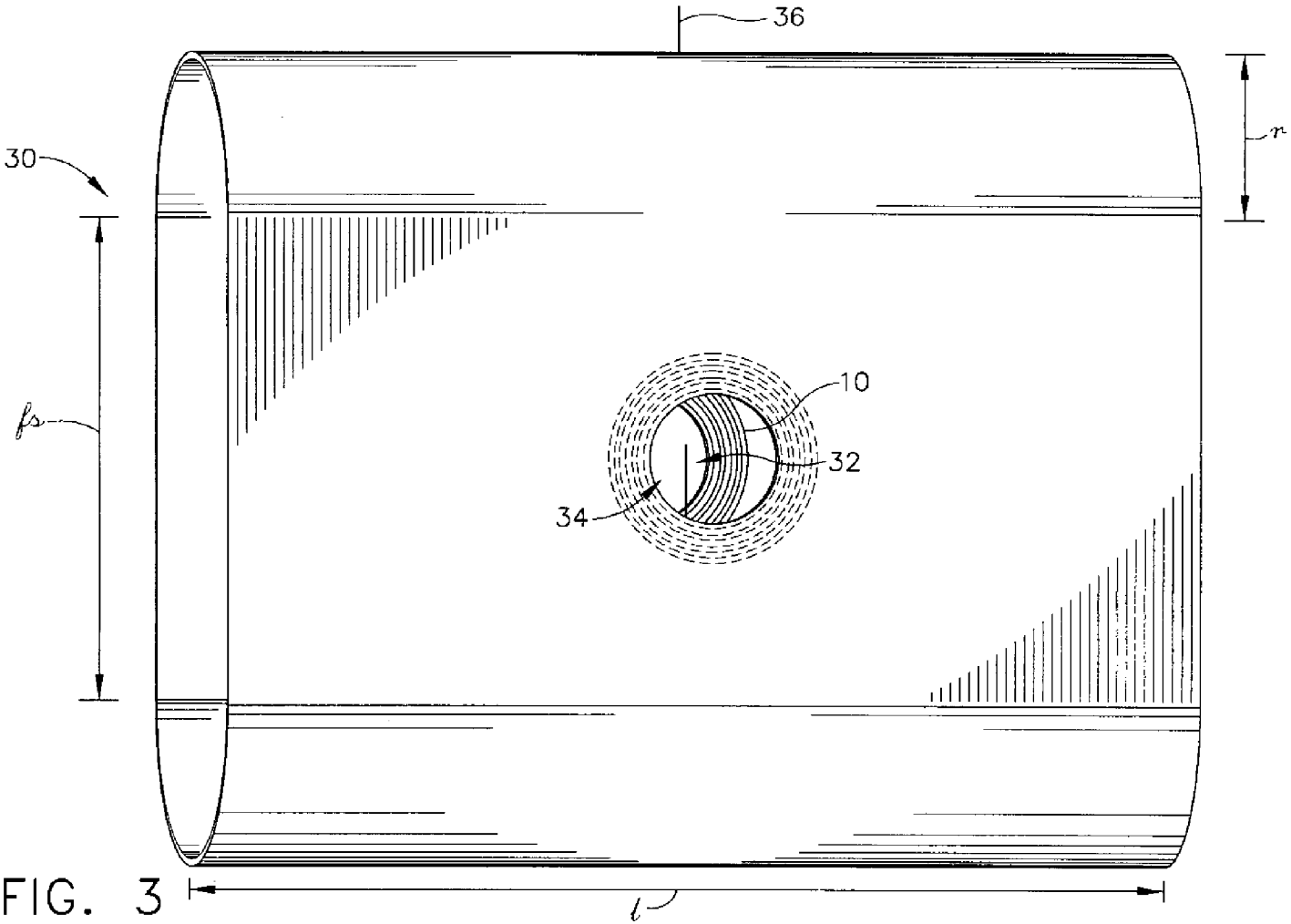
FIG. 3 is section of exemplary fuselage employed to measure current distribution on the fuselage.

Referring next to FIG. 3, a simulated fuselage section 30 illustrates the principle of operation of the present invention. A source antenna 32 represents an exemplary PED as a source of EMI. The source antenna is completely surrounded by the metal skin of the fuselage 30. The fuselage has windows 34 at intervals along the length of the fuselage, which provide a path for EMI to escape the interior of the fuselage. One or more external antennas 36 may be positioned on the exterior of the fuselage 30. A normal passenger mobile platform includes a plurality of antennas 36 for various systems, e.g., communication and navigation systems. The antennas 36 are typically located at various locations fore and aft, and are mounted on the top or bottom centerlines of the mobile platform. For clarity, FIG. 3 illustrates just a segment of a fuselage, having a single source antenna 32, a single victim antenna 36 and a single window 34. However, it will be readily understood that the present invention is applicable to multi-antennas, multi-source and multi-window arrangements such as found in a typical passenger mobile platform.

The choke ring structures 10 are positioned around each window 34 of the mobile platform. When EMI signals are generated by the source antenna 32—e.g., PEDs located inside the fuselage 30, the choke rings 10 attenuate EMI radiating through the surface of the fuselage by forming a directional pattern that is directed generally at right angles to a vertical center plane through centerlines of the windows and orthogonal to fuselage 30. In this way, the strongest EMI is directed away from the victim antennas 36, and the EMI signals from the source 32 diminish in strength as they propagate from the orthogonal centerline through the window 34. Thus, while some portion of the EMI signals are received by the victim antennas 36, the received EMI signals are greatly attenuated relative to the intended signals, and pose significantly less risk of interference with the electronics of the mobile platform than would be possible without the choke ring structures 10.

While the choke ring structure 10 is incorporated into the interior skin of the mobile platform fuselage in the example shown in FIGS. 1 and 2, it will be understood that the CRS 10 may be installed in either or both of the inside skin 12 or the exterior skin (not shown) of the fuselage, or alternately, may be placed between the interior 12 or exterior skin.

The choke ring structure 10 is preferably formed of metallic, electromagnetically conductive material, such as copper beryllium, Monel®, tin plated copper clad steel, powder coated aluminum, stainless steel or similar antenna material.

Figure 4:
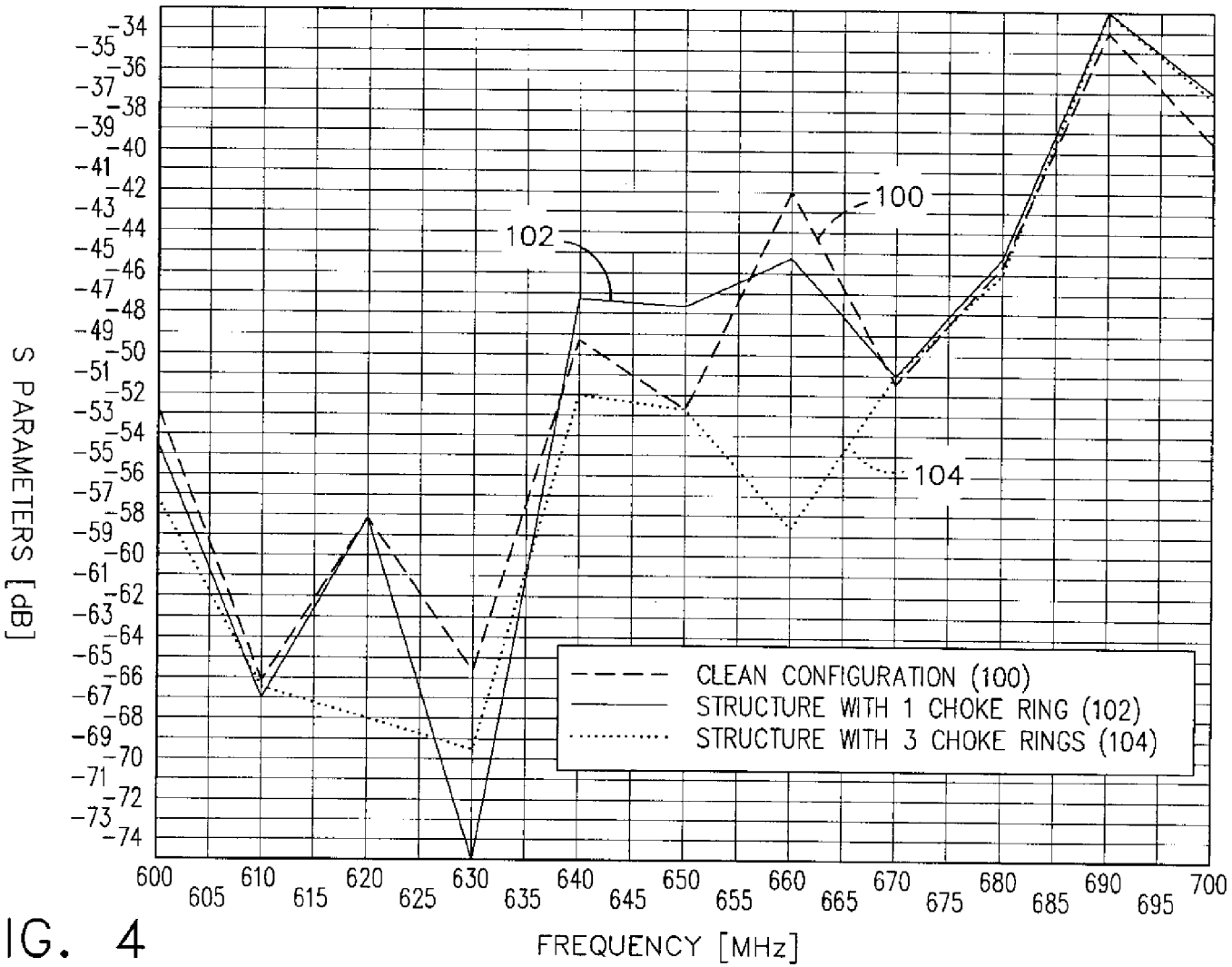
FIG. 4 is a graph comparing attenuation levels for various configurations of windows with and without choke ring structures.
Figure 5:
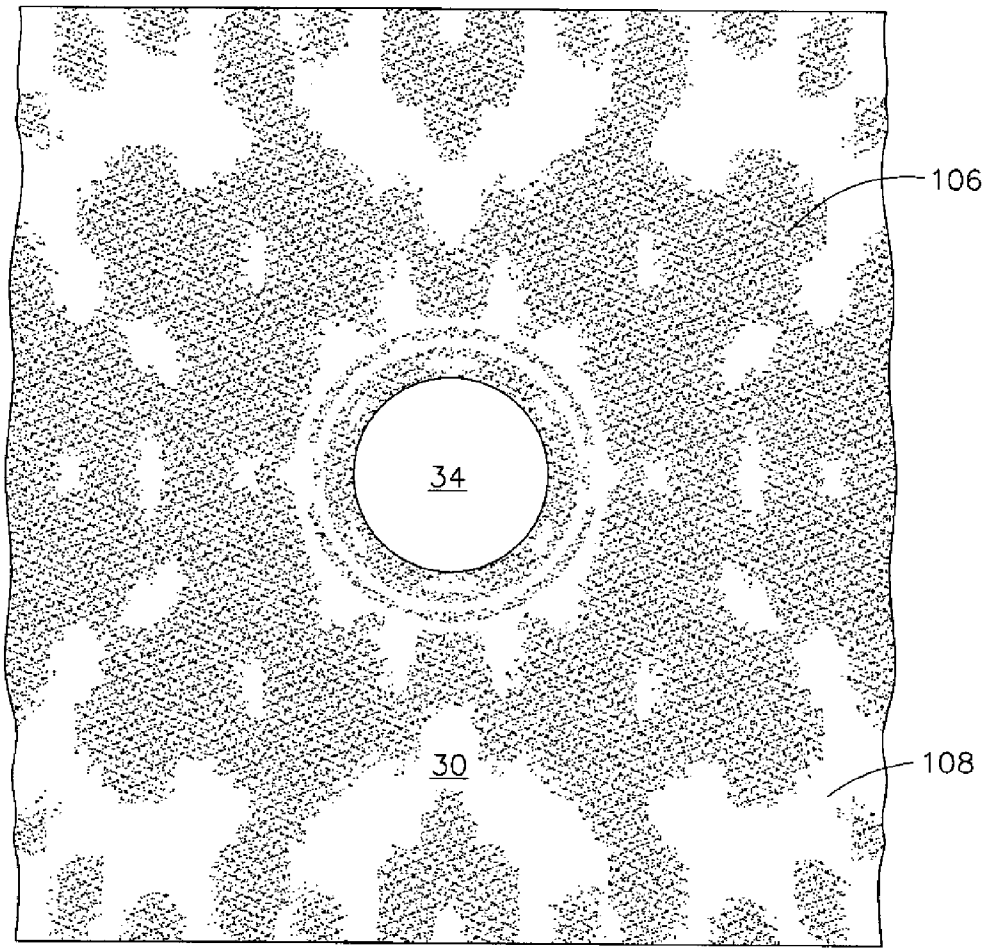
FIG. 5 illustrates the current distribution in the skin of a simulated fuselage without a choke ring structure.
Figure 6:
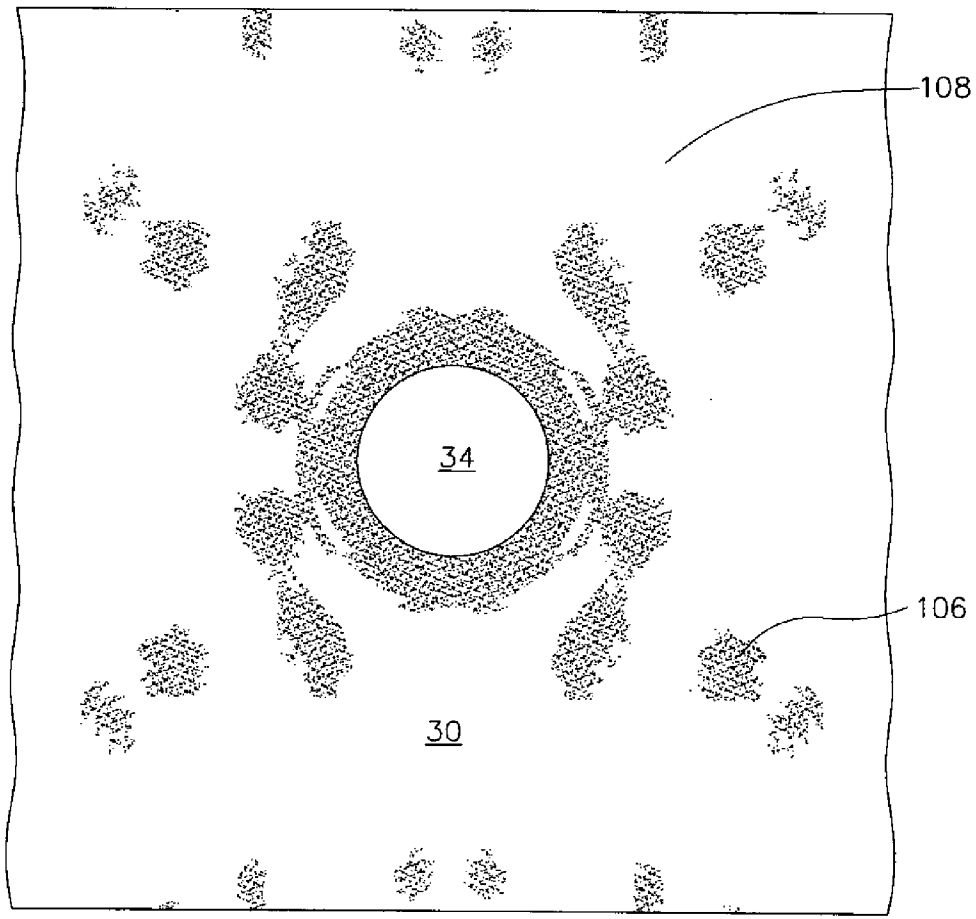
FIG. 6 illustrates the current distribution in the skin of the simulated fuselage with a choke ring structure.

Referring next to FIG. 4, a graph illustrates the results of an analysis designed to compare attenuation levels for various configurations of windows with and without choke ring structures 10. In the configuration represented by FIG. 3, isolation results were determined for a cylinder or fuselage 30 having the following configuration:

Cylinder length (l)=80 in. (approx.)
Cylinder radius (r)=42 in. (approx.)
Flat section (fs) of body=24 in.
Window (34) radius=12 in.
Resonant frequency=700 MHz
Choke ring (10) depth=d=$\lambda_r$/3.5
Source antenna (32)—dipole within cylinder
Victim antenna (36)—simulated mobile platform blade at top centerline The broken line 100 represents a response for a window configuration without the choke ring structure 10. A solid line 102 represents a response for a choke ring structure 10 having only a single ring segment. In the simplest form in which the choke ring structure 10 includes a singular ring, a lower level of signal reduction is provided; in some instances, the single-ring configuration may be sufficient to achieve a desired level of signal attenuation. Finally, a dotted line 104 represents a response for a choke ring structure 10 having three ring segments. As indicated in FIG. 4, a tuned response occurred at 660 MHz, a slightly lower frequency than the designed resonant frequency. Attenuation of the EMI for the 3-ring choke ring structure 10 was approximately 20 dB greater than the configuration without a choke ring structure. There was an obvious reduction in surface current on the fuselage 30 when the EMI was predicted with the three-ring choke ring structure 10 installed around the window 34, as opposed to when EMI was predicted without a choke ring structure 10 around the window 34. FIG. 5 illustrates the current distribution in the skin of the simulated fuselage 30 without a choke ring structure. FIG. 6 illustrates the current distribution in the skin of the simulated fuselage when a choke ring structure having three ring segments was used. FIGS. 5 and 6 were developed during the same simulation/analysis represented by FIG. 4. FIGS. 5 and 6 depict the current distribution that results on the surface of the simulated fuselage. In both FIGS. 5 and 6, the stippled areas 106 represent areas of the fuselage surface 30 where current intensity was high. The clear regions 108 represent areas of the fuselage surface 30 having low current intensity. As is apparent from the graphic representations, the area of greater current intensity was significantly greater in the ring-less configuration than for the configuration with the three choke ring structure 10. The results for the choke ring structure 10 having three rings 14, 16 18 resulted in predominantly low current intensity levels except for minor sidelobe areas in the immediate proximity of the window.

It is known that certain frequency bands are allocated for various aviation communications and navigation systems (e.g., GPS), and for various PEDs (cellular phones, radio and UHF broadcasts, etc.) While such frequency bands are of concern for designing the various choke ring configurations, the choke ring structure may be designed to attenuate signals in all or some of the frequency bands, depending on cost considerations, the likelihood that some PEDs are used more than others, and various other combinations. Table 1 provides a non-exclusive listing of some relevant frequency bands applicable to mobile platform communication and navigation systems.

TABLE 1

| System Designation | Transmit Band (MHz) | Receive Band (MHz) |
|---|---|---|
| ATC/Mode S | 1089-1091 | 1027-1033 |
| DME | 1025-1150 | 962-1213 |
| ELT | 406.2-406.3 | N/A |
| FD AES | 1626.5-1660.5 | 1530-1556 |
| Glideslope Capture | N/A | 108-112 |
| Glideslope Track | N/A | 329-335 |
| GPS L2 | N/A | 1217-1237 |
| GPS L1 | N/A | 1565-1585 |
| HF | 2-32 | 2-32 |
| IFF | 1089-1091 | 1029.5-1030.5 |
| Localizer | N/A | 108-112 |
| LRRA | 4250-4350 | 4250-4350 |
| Marker Beacon | N/A | 74.6-75.4 |
| MLS | N/A | 5031.1-5090.7 |
| TARS | 894-896 | 849-851 |
| TCAS | 1029.99-1030.01 | 1089.9-1090.1 |
| UHF-SATCOM | 292.5-318.5 | 243.5-270 |
| UHF-TV | N/A | 470-880 |
| UHF-AM | 225-399.975 | 225-399.975 |
| VHF-ACARS | 131.55 | 131.55 |
| VHF-AM | 116-151.975 | 116-151.975 |
| VHF-FM | 150-173 | 150-173 |
| VOR/ILS | N/A | 108-112 |
| Weather RADAR | 9353.8-9354.2 | 9353.8-9354.2 |

It should be noted that the square groove configuration shown in FIGS. 1 and 2 is exemplary, and that different profiles may be employed depending on the design criteria, for example, various frequencies that are sought to be attenuated. Thus, the bottom of the groove may be rounded, i.e., concave or convex, or may converge to a point, i.e., a sawtooth profile. Different profiles may be employed to increase the bandwidth of the response. Similarly, surfaces 14*a*, 16*a*, 18*a* can be modified for adjusting the bandwidth. Each particular application involves the same iterative process described above, with analysis and testing. Significant geometry and/or frequency changes may result in new profiles each of which follow the same iterative process.

While the present invention is illustrated in the embodiment of a mobile platform window configuration to reduce EMI associated with PEDs from interference with electronics systems, the choke ring structures may be used to prevent EMI generated from PEDs in other circumstances too numerous to list here. For example, passenger trains are also susceptible to EMI produced from internally operated PEDs, and would be within the scope of the present invention, as would a stationary communications station having a metal structure with windows adjacent to antennas placed outside of the communications station. Thus, the present invention may be applied in various ground-based and non-transportation related applications, as well as in mobile platform applications.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A choke ring apparatus for attenuation of electromagnetic waves propagating from an interior space enclosed by an aircraft fuselage comprising:

a ground plane mounted on a surface of the fuselage, the ground plane defining an aperture for receiving a window; and at least one ring element attached to the ground plane arranged surrounding a periphery of the aperture and extending outwardly from the ground plane;

wherein the choke ring apparatus configured to attenuate electromagnetic waves propagating through the aperture.

2. The choke ring apparatus of claim 1, including a window disposed in the aperture.

3. The choke ring apparatus of claim 1, wherein the at least one ring element includes a plurality of concentric ring elements attached to the ground plane arranged about a periphery of the aperture, the plurality of ring elements defining at least one groove therebetween.

4. The choke ring apparatus of claim 3 wherein each ring element of the plurality of ring elements comprises a ridge surface of a predetermined width at a distal edge of the ring element opposite the ground plane.

5. The choke ring apparatus of claim 4, wherein adjacent ring elements of the plurality of ring elements define the groove therebetween wherein the width of the ridge surfaces and a width of the groove between adjacent ring elements are approximately equal.

6. The choke ring apparatus of claim 5, wherein and the depth of the groove therebetween is determined based on at least one predetermined resonant frequency of the electromagnetic waves.

7. The choke ring apparatus of claim 3, wherein the width of the ridge surfaces and the grooves is predetermined by a predetermined resonant $\omega$ having a wavelength $\lambda_r$ and the grooves having a depth d approximately determined by the equation $d=\lambda_r/3.5$.

8. The choke ring apparatus of claim 7, wherein the width of the ridge surfaces and the grooves are approximately equal to one-fourth of the groove depth.

9. The choke ring apparatus of claim 3, wherein the ridge surfaces are flat.

10. The choke ring apparatus of claim 3, wherein the grooves are filled with a dielectric material selected from the group consisting of ceramic, mica, glass, plastics, and aluminum oxide.

11. The choke ring apparatus of claim 1, wherein the at least one ring element is circular.

12. The choke ring apparatus of claim 1, wherein the choke ring apparatus includes at least three ring elements.

13. The choke ring apparatus of claim 1, wherein the choke ring apparatus is elliptical or rectangular.

14. An electromagnetic interference attenuation system for a mobile platform comprising:

a fuselage having an interior surface portion and an exterior surface portion, and a plurality of choke ring portions, each choke ring portion of the plurality of choke ring portions being disposed between the interior and exterior surface portions; and at least one communications antenna mounted on the fuselage exterior surface portion for receiving electromagnetic signals for onboard mobile platform electronic systems;

each choke ring portion having:

a ground plane mounted on a surface of the fuselage, the ground plane defining an aperture for receiving a window; and at least one ring element attached to the ground plane arranged surrounding a periphery of the aperture and extending outwardly from the ground plane;

wherein the choke ring apparatus configured to attenuate electromagnetic waves propagating through the aperture.

15. The system of claim 14, wherein the at least one ring element includes a plurality of concentric ring elements attached to the ground plane arranged coaxially about a periphery of the axial aperture and extending from the ground plane, the plurality of ring elements defining at least one groove therebetween; each ring element of the plurality of ring elements having a ridge surface of a predetermined width at an edge of the ring element opposite the ground plane.

16. The system of claim 15, wherein the predetermined width of the ridge surfaces and a width of the groove between adjacent ring elements, are approximately equal, and the groove has a depth determined based on at least one predetermined resonant frequency of electromagnetic interference.

17. The system of claim 16, wherein the grooves and the ridge surfaces define a contoured profile selected from the group consisting of: flat, concave, convex, waveform and pointed.

18. A window assembly for a mobile platform comprising:

a choke ring structure surrounding a periphery of the window assembly wherein RF energy generated internally in the mobile platform is inhibited by the choke ring structure from interfering with mobile platform antennas disposed externally on the mobile platform.

19. The window assembly of claim 18, wherein the choke ring structure is disposed internally of the mobile platform.

20. The improved mobile platform window assembly of claim 19, wherein the choke ring structure is disposed externally of the mobile platform.

* * * * *

UNITED STATES PATENT AND TRADEMARK OFFICE

CERTIFICATE OF CORRECTION

PATENT NO. : 7,525,496 B2
APPLICATION NO. : 12/122042
DATED : April 28, 2009
INVENTOR(S) : Francque et al.

It is certified that error appears in the above-identified patent and that said Letters Patent is hereby corrected as shown below:

Column 5, Line 3, "and 18a in relation to the depth d of the adjacent grooves 15," should be changed to --and 18a in relation to the depth *d* of the adjacent grooves 15,--.

Column 5, Line 6, "The depth d of the choke ring is approximately determined by" should be changed to --The depth *d* of the choke ring is approximately determined by--.

Column 5, Line 11, "grooves 15 and 17 are about one quarter of the depth (d/4) of" should be changed to --grooves 15 and 17 are about one quarter of the depth (*d*/4) of--.

Column 6, Line 14, "Cylinder length (l)=80 in. (approx.)" should be changed to --Cylinder length (*l*)=80 in. (approx.)--.

Column 6, Line 15, "Cylinder radius (r)=42 in. (approx.)" should be changed to --Cylinder radius (*r*)=42 in. (approx.)--.

Column 6, Line 16, "Flat section (fs) of body=24 in." should be changed to --Flat section (*fs*) of body=24 in.--.

Column 6, Line 19, "Choke ring (10) depth=d=$\lambda_t$/3.5" should be changed to --Choke ring (10) depth=*d*=$\lambda_t$/3.5--.

Column 8, Line 39, "grooves having a depth d approximately determined by the" should be changed to --grooves having a depth *d* approximately determined by the--.

Column 8, Line 40, "equation d=$\lambda_t$/3.5." should be changed to --equation *d*=$\lambda_t$/3.5.--.

Signed and Sealed this

Twenty-fifth Day of August, 2009

David J. Kappos

David J. Kappos
*Director of the United States Patent and Trademark Office*